US006669026B2

(12) United States Patent
Cohen et al.

(10) Patent No.: US 6,669,026 B2
(45) Date of Patent: Dec. 30, 2003

(54) PORTABLE SCREENING PLANT WITH DISPLACEABLE ECCENTRIC

(75) Inventors: Douglas J. Cohen, Columbus, OH (US); Mauricio A. Escobar, Columbus, OH (US)

(73) Assignee: Ohio Central Steel Company, Reynoldsburg, OH (US)

( * ) Notice: Subject to any disclaimer, the term of this patent is extended or adjusted under 35 U.S.C. 154(b) by 0 days.

(21) Appl. No.: 10/159,830

(22) Filed: May 31, 2002

(65) Prior Publication Data

US 2002/0195378 A1 Dec. 26, 2002

Related U.S. Application Data

(63) Continuation-in-part of application No. 10/100,455, filed on Mar. 18, 2002, and a continuation-in-part of application No. 09/704,168, filed on Nov. 1, 2000, now Pat. No. 6,401,933.

(51) Int. Cl.[7] ..... B07B 1/44

(52) U.S. Cl. ..... 209/366.5; 74/87

(58) Field of Search ..... 209/309, 346, 209/363, 364, 366.5, 367; 74/86, 87, 571 L

(56) References Cited

U.S. PATENT DOCUMENTS

| | | | | | |
|---|---|---|---|---|---|
| 900,313 | A | * | 10/1908 | Schutz | 74/86 |
| 952,565 | A | | 3/1910 | Fraser | |
| 1,128,729 | A | | 2/1915 | Shank | |
| 1,207,847 | A | | 12/1916 | Brantingham | |
| 1,217,786 | A | | 2/1917 | Lemaster | |
| 1,694,356 | A | | 12/1928 | Royer | |
| 1,736,054 | A | | 11/1929 | Royer | |
| 2,500,966 | A | | 3/1950 | Thompson | |
| 2,511,885 | A | | 6/1950 | Thompson | |
| 2,814,387 | A | * | 11/1957 | McWilliams | 209/247 |
| 2,963,914 | A | * | 12/1960 | Dupouy | 74/87 |
| 3,822,604 | A | * | 7/1974 | Grimmer | 74/87 |
| 4,033,193 | A | * | 7/1977 | Brander | 74/61 |
| 4,237,000 | A | | 12/1980 | Read et al. | |
| 4,363,725 | A | | 12/1982 | Morita et al. | |
| 4,879,023 | A | | 11/1989 | Mallaghan | |
| 4,923,597 | A | | 5/1990 | Anderson et al. | |
| 4,983,280 | A | | 1/1991 | Eriksson | |
| 5,106,490 | A | | 4/1992 | McDonald | |
| 5,234,564 | A | | 8/1993 | Smith | |
| 5,333,725 | A | | 8/1994 | Douglas | |
| 5,482,165 | A | | 1/1996 | Johnston | |
| 5,794,787 | A | | 8/1998 | Johnston | |
| 5,842,578 | A | | 12/1998 | Cordeiro | |
| 5,899,340 | A | | 5/1999 | MacNaughton | |
| 5,957,302 | A | * | 9/1999 | Douglas | 209/421 |
| 6,000,553 | A | | 12/1999 | Cohen et al. | |
| 6,029,822 | A | * | 2/2000 | Skoropa | 209/326 |
| 6,098,812 | A | * | 8/2000 | Douglas | 209/420 |
| 6,186,338 | B1 | | 2/2001 | Douglas | |

FOREIGN PATENT DOCUMENTS

| | | |
|---|---|---|
| GB | 554680 | 7/1943 |

* cited by examiner

*Primary Examiner*—Donald P. Walsh
*Assistant Examiner*—Mark J Beauchaine
(74) *Attorney, Agent, or Firm*—Jason H. Foster; Kremblas, Foster, Phillips & Pollick

(57) ABSTRACT

A vibration-reducing eccentric weight system mounted to the driveshaft of a screen box in a portable screening plant with the eccentric weight system's center of gravity on the driveshaft's axis of rotation. The eccentric weight system includes a weight that is radially slidably mounted to the driveshaft, but biased so that its center of gravity is spaced from the driveshaft's axis of rotation during slow and no rotation. Upon rotation above a preselected speed, the centrifugal force displaces the weight radially outwardly. This causes a gradually increasing vibration corresponding to gradually increasing distance between the weight's center of gravity and the driveshaft's axis of rotation.

12 Claims, 10 Drawing Sheets

PORTABLE SCREENING PLANT WITH DISPLACEABLE ECCENTRIC

CROSS-REFERENCE TO RELATED APPLICATIONS

This application is a continuation-in-part of U.S. application Ser. No. 09/704,168 filed Nov. 1, 2000, now U.S. Pat. No. 6,401,933 and U.S. application Ser. No. 10/100,455 filed Mar. 18, 2002.

STATEMENT REGARDING FEDERALLY-SPONSORED RESEARCH AND DEVELOPMENT (Not Applicable)

REFERENCE TO A "MICROFICHE APPENDIX"

(Not Applicable)

BACKGROUND OF THE INVENTION

1. Field of the Invention

The invention relates generally to screening plants, which use vibratory screens of varying meshes to separate matter poured onto the screens, and more particularly relates to a displaceable eccentric that decreases unexpected, violent vibrations during starting and stopping of the vibratory screen of a portable screening plant.

2. Description of the Related Art

Conventional screening plants have been in use for some time. Such machines are used to separate particulate materials, which can be defined broadly as any material made up of a plurality of pieces of random size and shape, such as road construction debris, gravel, soil, sand and recyclables. Examples of screening plants are shown in many U.S. patents, such as U.S. Pat. No. 6,000,553 to Cohen et al., U.S. Pat. No. 5,106,490 to McDonald and U.S. Pat. No. 4,923,597 to Anderson et al. Some screening plants are portable, permitting them to be transported to the location where excavation, mining or construction takes place and conveyed around the location.

Conventional screening plants ordinarily include an inclined, wide upper screen onto which material is poured either directly from a loading vehicle or by means of a conveyor. The upper screen vibrates, causing pieces of matter that are larger than the apertures of the screen to slide down its inclined surface onto a pile of larger pieces of matter that collect on one side of the machine. Matter that is smaller than the apertures in the upper screen drops through the apertures, typically onto a second angled screen with still smaller apertures, to be separated further. There can be numerous angled screens of various aperture sizes.

The drive mechanism for most screening plants includes an electric motor or an internal combustion engine that drives a pump for pressurizing hydraulic fluid. An example of such a mechanism is disclosed in U.S. Pat. No. 4,237,000 to Read. The hydraulic fluid is pumped to a hydraulic motor that rotates a driveshaft. The driveshaft extends through a screen box, which is a stack of similarly angled, parallel screens with progressively smaller apertures on each lower screen. The screens are attached to a rigid, peripheral frame. Fixed eccentric weights are mounted on opposite sides of the screen box to the driveshaft.

As the driveshaft rotates, the eccentric weights revolve about the axis of the driveshaft, causing the driveshaft and screen box to vibrate. The vibration causes the finer particulate matter, such as sand, to pass through the lowest screen layer. This finer particulate matter is often conveyed by an elevating conveyor from beneath the screen box to a pile spaced from the machine.

Problems arise from the use of conventional screening plants due to the vibration of the screens. The screens are vibrated, as described above, by rotating eccentric weights about a driveshaft axis. The conventional eccentric weights are massive plates with centers of gravity offset from the axis of the driveshaft, much like a crankshaft on an automobile engine. In order to begin rotating the driveshaft, the weights must be "lifted over" the driveshaft by a substantial torque applied to the driveshaft. However, once the driveshaft is rotating at operating speed, the torque needed to keep it going is much lower.

The conventional internal combustion engine and hydraulic motor combination provides the needed torque for startup and operation, but is expensive and complex. A drive system that can only provide the small torque needed at operating speed does not have enough torque to start the driveshaft rotating because the difference between the startup torque and the operating torque can be very substantial.

Additionally, the fixed eccentric weights that cause the desired vibration of the screen box at operating speed can cause the screen box to shake violently at speeds less than operating speed. However, the machine must operate at speeds less than operating speed, such as during a warm-up period, and when the machine speed is being increased and decreased during startup and shutdown. Thus, during warm-up, startup and shutoff of the screening plant the screen box can vibrate in an undesirable manner that is potentially destructive to the screening plant and gives the screening plant the appearance that it is malfunctioning.

Therefore, the need exists for an apparatus that causes the screen box to vibrate at operating speed, but does not expose the screening machine to damage at other speeds and can operate with a less powerful drive system.

BRIEF SUMMARY OF THE INVENTION

The invention is a vibration-control eccentric weight system for the vibratory screen of a screening plant. The screen screens particulate matter positioned thereon. The apparatus reduces or eliminates the violent vibrations of the screen during warm-up, startup and slowdown of the screening plant. The screening plant also has a driveshaft rotatably mounted to the screen and drivingly linked to a motor.

The eccentric weight system includes a plate rigidly mounted to the driveshaft. Another part of the eccentric weight system is a radially displaceable weight, which has a finger mounted within a radial slot formed in the plate. At least one bias, which is preferably a set of coil springs, is mounted to the plate and the weight for biasing the weight's center of gravity toward close proximity to, but still spaced from, the driveshaft's axis of rotation.

During no and slow rotation of the driveshaft, the eccentric weight system does not serve as an eccentric to any significant degree because the center of gravity of the eccentric weight system, which includes the weight, the plate and the springs, is aligned substantially along the driveshaft's axis of rotation. This alignment is not perfect, and some eccentricity exists. The center of gravity of the weight, however, is spaced from the axis of the driveshaft. As the driveshaft rotates more rapidly, centrifugal force overcomes the bias of the spring and the weight is displaced radially outwardly. As the weight moves radially outwardly, its center of gravity is moved farther away from the axis of rotation of the driveshaft. This causes the eccentric weight system to serve more as an eccentric, causing the driveshaft, and the connected screen, to vibrate. As the driveshaft rotates more rapidly, the weight moves radially outwardly a greater distance and is more eccentric.

Figure 1:
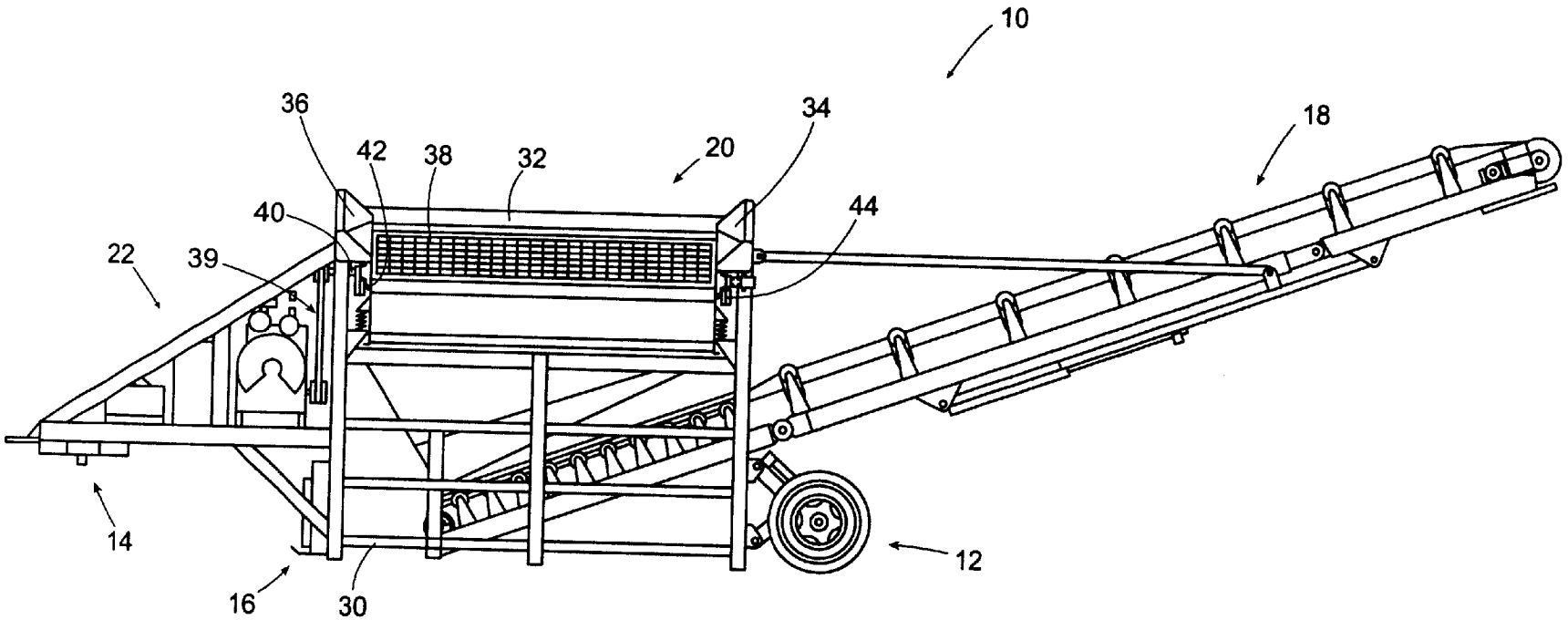
FIG. 1 is a side view illustrating a screening plant into which the invention is incorporated.

In describing the preferred embodiment of the invention that is illustrated in the drawings, specific terminology will be resorted to for the sake of clarity. However, it is not intended that the invention be limited to the specific term so selected and it is to be understood that each specific term includes all technical equivalents that operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

A screening plant 10 is shown in FIG. 1 having several major components that are conventionally used on screening plants. The wheels 12 and the fifth wheel pin 14 permit towing of the entire plant. The wheels 12 and the feet 16 can be raised and lowered for resting the housing 20 of the screening plant 10 directly on the earth. The feet 16 are used to level the structure, if necessary.

An elevating conveyor 18 conveys the finer particulate matter from beneath the separating portion of the screening plant 10 onto a pile or into the bed of a vehicle. The power plant 22 is rigidly mounted to the housing 20, and preferably includes an internal combustion engine and a fuel tank.

The engine is drivingly linked (in the embodiment shown) by a belt and pulley apparatus 39, to the driveshaft 40 rotatably mounted to the screen box 38. It will be understood that the belt drive can be replaced by a conventional hydraulic drive system, a chain drive, an electric motor or any other equivalent drive apparatus.

The weights 42 and 44 are mounted to the driveshaft 40 as described in more detail below, to form eccentrics on the driveshaft 40 when the driveshaft is rotating above a preselected rate, normally measured in revolutions per minute (rpm).

Figure 2:
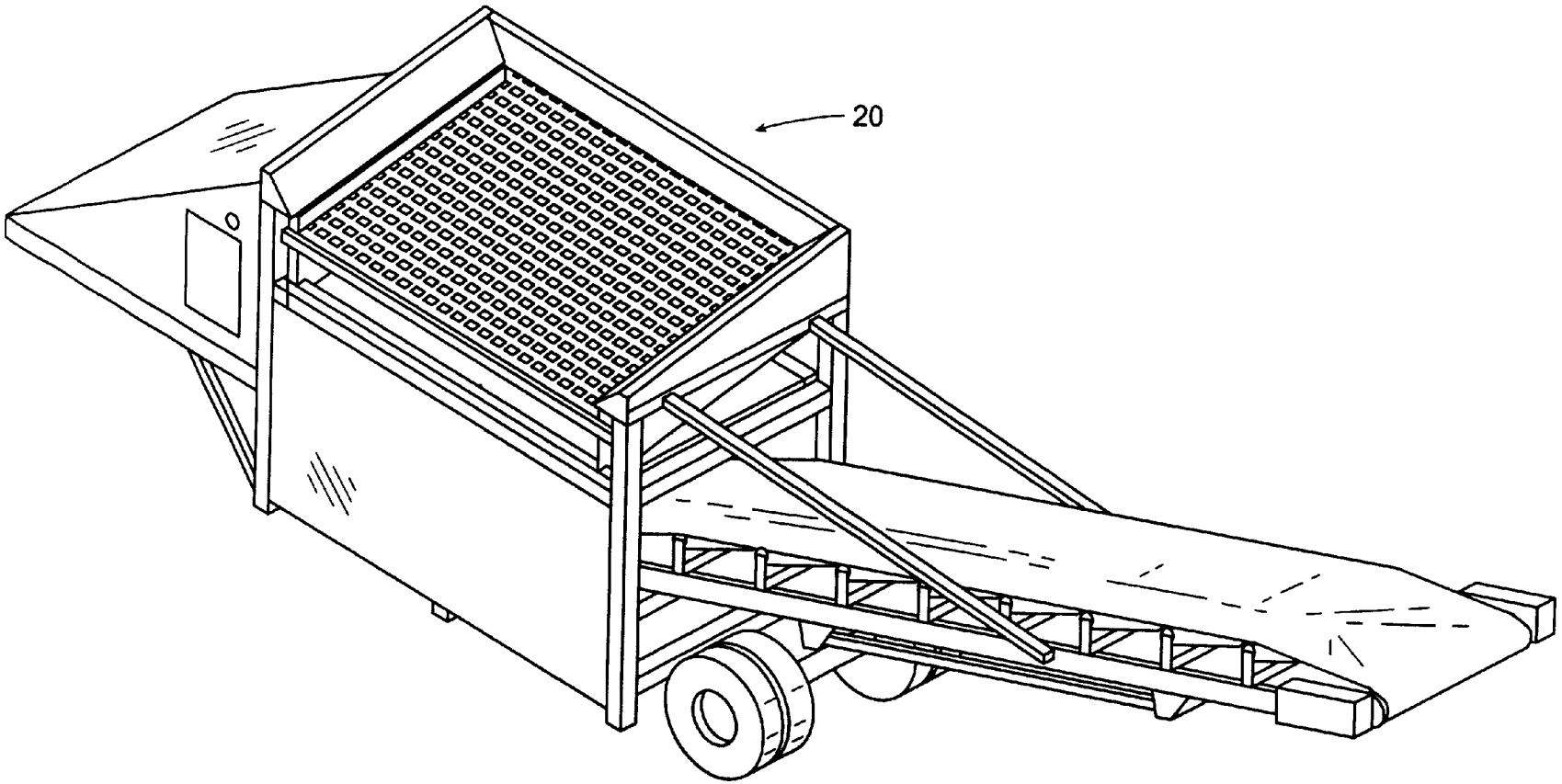
FIG. 2 is a view in perspective illustrating a screening plant into which the invention is incorporated

The housing 20 includes the frame 30 and the attached walls (shown in FIG. 2) that enclose the frame 30. During operation, material is poured into the funnel region made up of the slanted walls 32, 34 and 36 and the housing elements in close proximity thereto. The screen box 38 vibrates and the material is screened into separate piles of different size particles.

The screening plant 10 of the present invention has structural features that distinguish it from existing machines. The most important features of the invention are shown in FIGS. 3 and 4, and in more detail in FIGS. 5 through 9.

Figure 3:
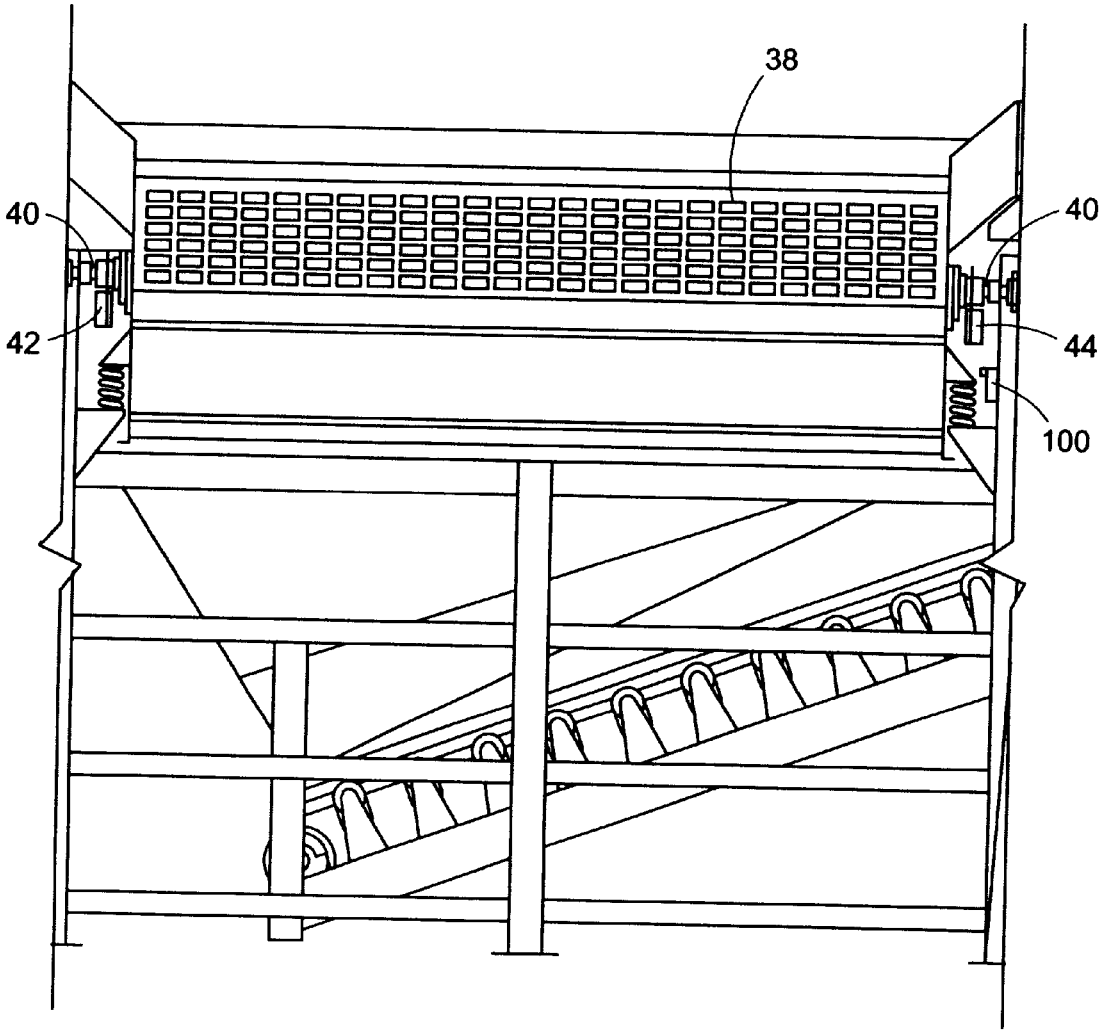
FIG. 3 is a side view illustrating a particular region of the screening plant.
Figure 4:
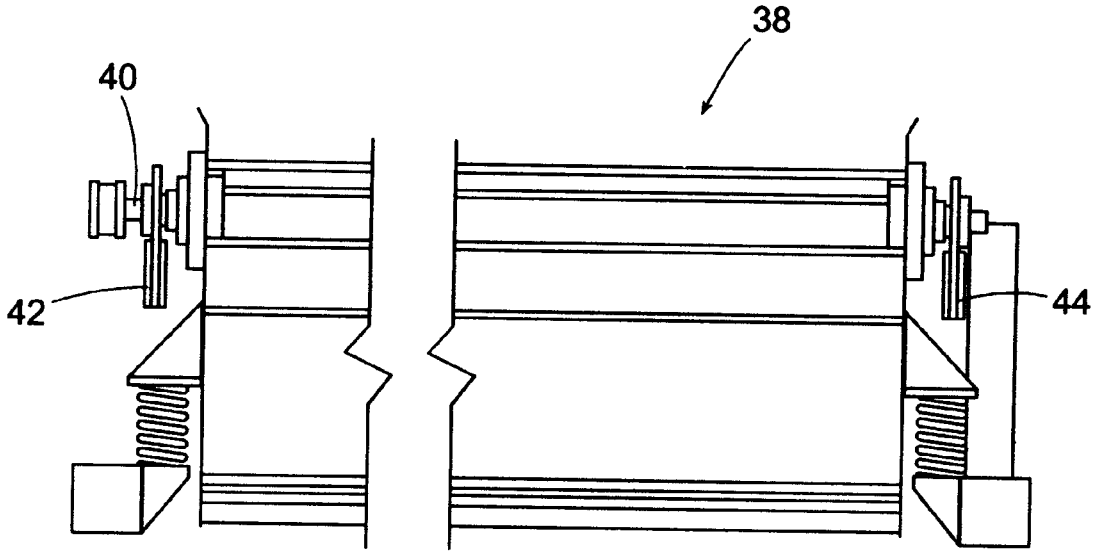
FIG. 4 is a side view illustrating the screen box and its connection to the screening plant.
Figure 5:
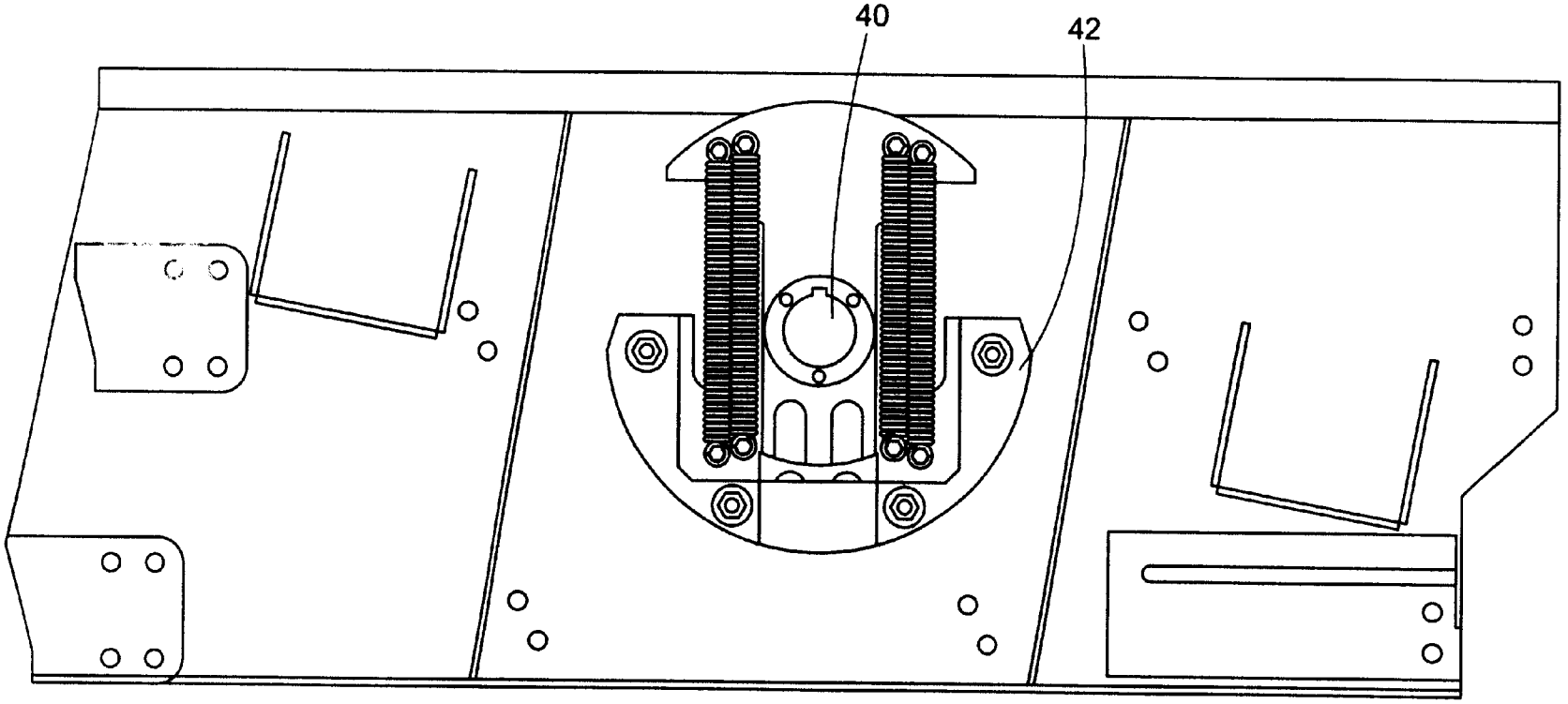
FIG. 5 is an end view illustrating the screen box and showing the invention in its operable position.
Figure 6:
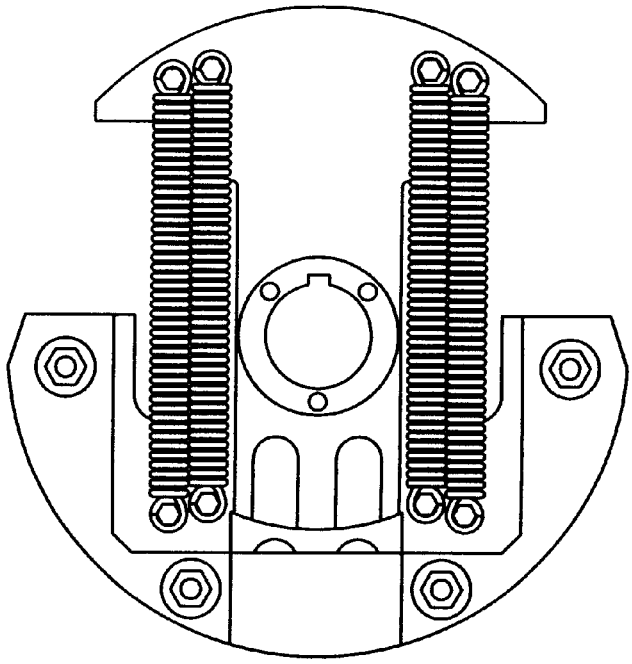
FIG. 6 is an end view illustrating the weight and driveshaft in the operating position.
Figure 9:
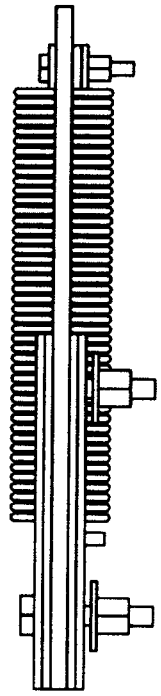
FIG. 9 is a side view illustrating the weight in the operating position.

FIGS. 3 and 4 show the eccentric weight systems, which include the weights 42 and 44, on opposite ends of the driveshaft 40 on opposite sides of the screen box 38. In FIGS. 3 and 4 the weights are shown as they appear during rotation of the driveshaft 40 at operating speed. FIGS. 5, 6 and 9 also show the eccentric weight system of the weight 42 as it appears during rotation of the driveshaft 40 at operating speed.

Figure 7:
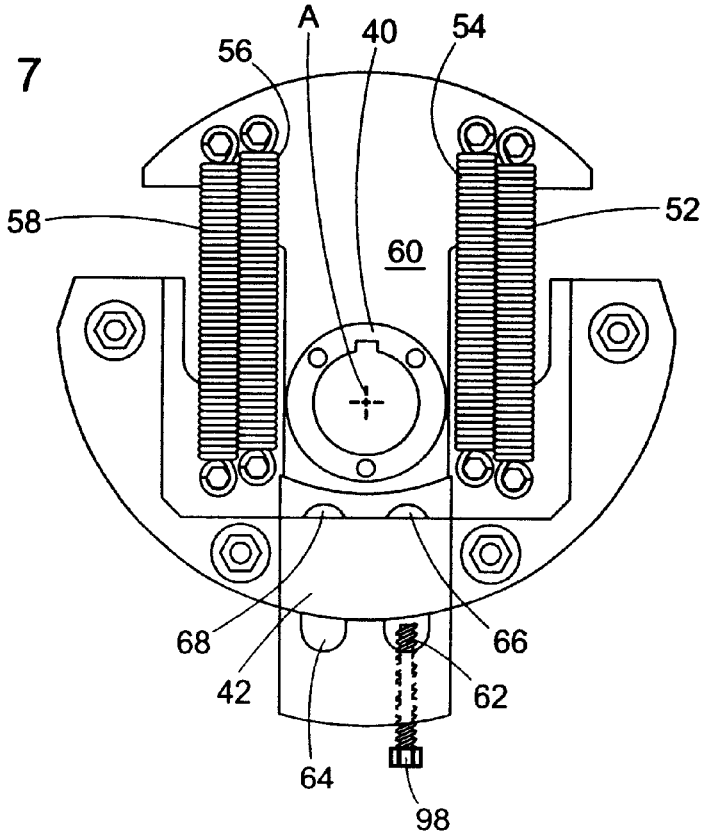
FIG. 7 is an end view illustrating the weight and driveshaft in the rest position.

FIG. 7 shows the eccentric weight system that includes the weight 42 in detail at its rest position. The following description of the eccentric weight system that includes the weight 42 is also an accurate description of the eccentric weight system that includes the weight 44 and its cooperating parts, which is identical except that it is a mirror image configuration.

The weight 42 is mounted to the driveshaft 40, which includes a direct attachment and attachment through one or more connecting structures. In the preferred embodiment, the weight 42 is mounted to a slotted plate 60 that is rigidly mounted to the driveshaft 40. The slotted plate 60 has a T-shaped body and is part of the eccentric weight system. A pair of slots 62 and 64 is formed at the lower end of the slotted plate 60 on the opposite side of the driveshaft 40 from the upper legs of the T. The fingers 66 and 68 extend from rigid attachment to the weight 42 and are inserted into the slots 62 and 64. The slots can be any selected length, for example approximately three inches.

Figure 8:
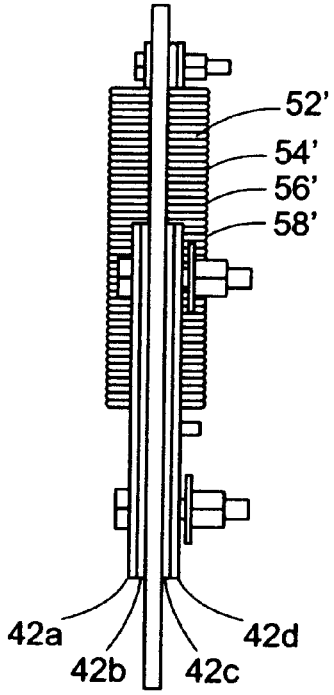
FIG. 8 is a side view illustrating the weight in the rest position.

The weight 42 consists of the weight plates 42*a*, 42*b*, 42*c* and 42*d* sandwiching the slotted plate 60 there between as shown in FIG. 8. The configuration of the weight plates 42*a*-42*d*, the slots 62 and 64 and the fingers 66 and 68 permits the weight 42 to slide radially along the path of the slots 62 and 64. Of course, any equivalent sliding structure can be substituted for the preferred structure. For example, the weight 42 could slide on a rod or a track.

Each slot has an inner slot end (the upper end in the orientation shown in FIG. 7) and an outer slot end (the lower end in the orientation shown in FIG. 7) that, when the fingers abut them, stop the movement of the weight 42. The inner slot ends of the slots 62 and 64 are formed, and the fingers 66 and 68 are positioned, so that the center of gravity of the weight 42 is spaced from the driveshaft's axis A when the fingers 66 and 68 abut the inner ends of the slots 62 and 64. This is referred to as the rest position, and it is shown in FIG. 7. However, although the weight's center of gravity is spaced from the axis of rotation at the rest position, the center of gravity of the eccentric weight system, which also includes the slotted plate 60 and the springs (described below), is aligned substantially along the axis of rotation when the weight is in the rest position. This alignment is not necessarily exact, because it would be too costly to create such a structure where very small vibrations are not harmful.

When the fingers 66 and 68 abut the outer slot ends, the weight 42 is at the operating position at which the center of gravity of the eccentric weight system is spaced a substantial distance from the driveshaft's axis of rotation. It is contemplated that the slots can be effectively "shortened" by obstructing the slot, or any other part of the path of the weight, with a screw, a pin or another structure, so as to be able to selectively position the weight's 42 rest and/or operating position. Such a screw 98 is mounted in the slot 62 shown in FIG. 7. Another screw can be positioned at the opposite end of the slot 62 so that the tips of the screws seat against the finger 66 at its opposite extreme positions.

The springs 52, 54, 56 and 58 are conventional coil springs mounted at one end to the legs of the upper end of the slotted plate 60 in the orientation shown in FIG. 7, and are mounted at their opposite ends to the weight 42. Another set of springs 52', 54', 56' and 58' are mounted to the slotted plate 60 and the weight 42 on the opposite side of the slotted plate 42 as the springs 52-58, as shown in FIG. 8.

The springs bias the weight 42 radially inwardly, tending to position the center of gravity of the weight 42 at a predetermined rest position spaced from the axis A of the driveshaft 40 when the weight 42 is at its rest position. The spring bias is greater than the combined effect of the force of gravity and any frictional resistance to sliding between the components when the driveshaft is at rest, and therefore the weight stays in the rest position when the driveshaft is at rest.

When the engine of the screening plant is started, it operates at low rpm and develops less torque than when it is operating at higher rpm. Therefore, a circumferential clutch is mounted between the engine and the driveshaft 40, so that when the operating speed of the engine reaches a preselected minimum, for example, 800-1000 rpm, the engine is drivingly linked to the driveshaft only when the engine is developing enough torque to rotate the driveshaft 40. Because a belt and pulley drive apparatus is used to link the engine to the driveshaft 40, slippage between the belt and pulleys prevents too sudden of a start in rotation of the driveshaft 40 when the clutch engages. It is to be emphasized that many other conventional drive systems can be substituted for the belt and pulley drive system.

When the driveshaft 40 is at rest and when it first begins to rotate, the bias of the springs 52-58 continues to exceed the combined effect of centrifugal force and frictional resistance to sliding. Thus, the springs maintain the weights 42 and 44 with their centers of gravity spaced from the axis A of the driveshaft 40 and the center of gravity of the eccentric weight system aligned substantially along the driveshaft's axis. As a result of the invention described above, during these initial stages of rotation the eccentric weight system is not serving as a significant eccentric. Therefore, the torque required to begin, and then increase the rate of, the rotation of the driveshaft 40 can be much smaller than on conventional, fixed-weight screening plants. Furthermore, the screening plant can be operated at this speed to warm up any hydraulic fluid, bearings, lubricants, and other components prior to vibrating. It is during vibration of the screen that the components of screening plants are exposed to the greatest wear and a warm-up period without vibration helps to decrease the wear of the screening plant.

When the driveshaft 40 rotates more rapidly, the increased centrifugal force begins to overcome the bias of the springs. At this point the weights 42 and 44 are displaced radially outwardly relative to their rest positions. Displacement of the weights displaces the centers of gravity of the weights even further from the axis A of the driveshaft 40 than when the weights were at the rest position, thereby displacing the centers of gravity of the eccentric weight systems from substantial alignment with the driveshaft axis, A. This causes oscillation of the screen box as the eccentric weight systems begin to function as significant eccentrics. The amplitude of oscillation is small initially, and therefore the screen box 38 vibrates only a small amount.

As the rotational speed of the engine increases further, however, the weights move further out, and the centrifugal force increases due to the increased space between the center of gravity of the eccentric weight system and the axis, A. As a result of the increased rotational speed, the weights are displaced progressively further out until the fingers 66 and 68 on the weight 42 seat against the outer ends of the slots 62 and 64, and the similar structures on the weight 44 function similarly. During this progressive displacement of the weights, there is an increase in the eccentricity of the eccentric weight system.

The outermost position of the weight 42 is the operating position, and is shown in FIGS. 6 and 9. The operating position of the weight 42 corresponds with a preselected engine driveshaft speed, for example approximately 2000 rpm. However, this can vary as will be apparent to one of ordinary skill in the art. Of course, if the machine were to be operated at a speed causing the weights to stay at any intermediate position between the rest and operating positions, the screen would still vibrate, just to an intermediate degree.

Once the weights are in the operating position, the eccentric weight systems cause the greatest expected amplitude of oscillation of an unloaded screen box 38. And because the screen box system was designed to operate at a preselected amplitude and frequency, it does not vibrate violently at operating speed because operating speed corresponds to this designed frequency and amplitude.

When the engine is shut off or slowed down, the rotational speed of the driveshaft decreases, thereby causing the bias of the springs to begin to overcome centrifugal force and friction. When this begins, the weights 42 and 44 are displaced radially inwardly under the bias of the springs that biases the weights' centers of gravity into closer proximity to the driveshaft axis. This occurs until the weights reach the rest position. As the weights move radially inwardly, the amplitude of oscillation of the screen box decreases in relation thereto as the centers of gravity of the eccentric weight systems approach the axis of the driveshaft. Thus, instead of vibrating violently like conventional screening plants, the screen box simply decreases in its amplitude of oscillation until it stops vibrating to any significant extent when the weights are at their rest position.

In addition to the preferred embodiment described above, there are many alternative embodiments of the present invention. For example, the coil spring could be replaced by any other type of conventional spring, such as an elastomeric material, a fluid spring (such as a gas spring) or a hydraulic cylinder that is controlled as to its length. All of these structures are considered equivalent to the bias embodied in the preferred coil springs.

Figure 10:
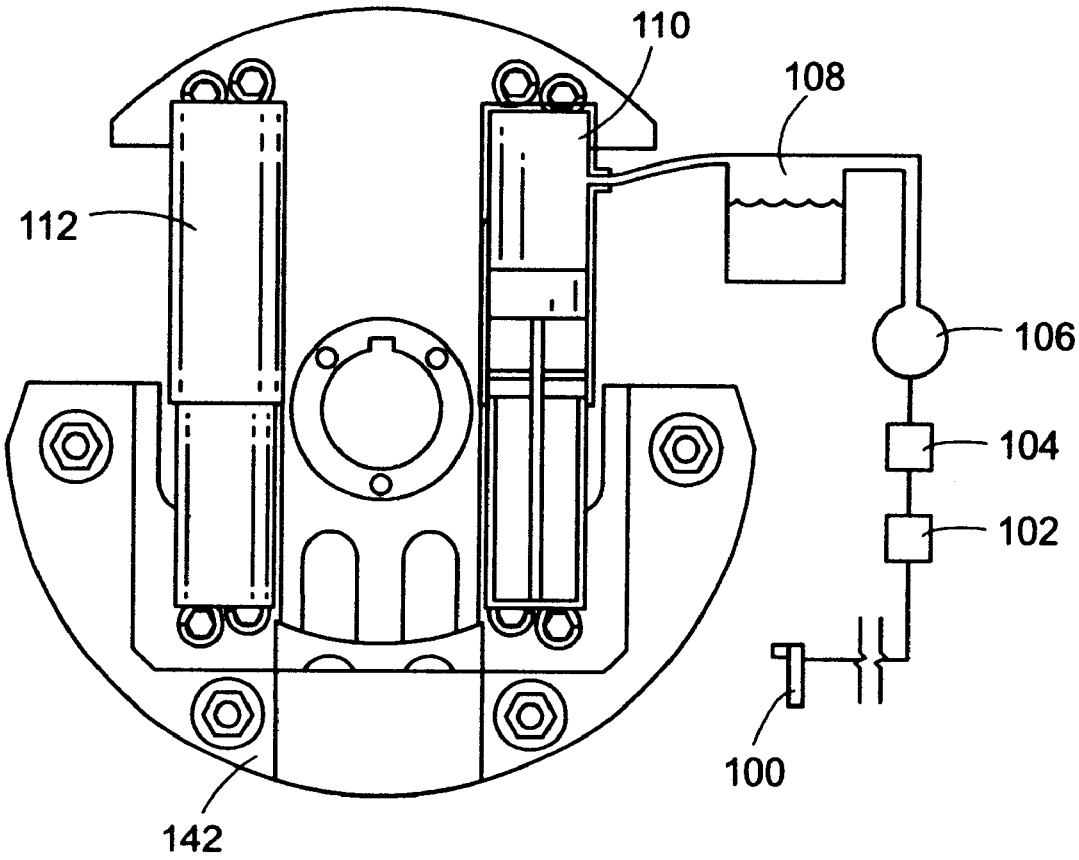
FIG. 10 is an end view illustrating an alternative embodiment of the present invention including a feedback loop mechanism.

Additionally, a feedback loop mechanism can be configured to cooperate with the conventional screening machine and the invention actively to control the position of the weights based upon the oscillatory parameters of the screen box. For example, the optical sensor 100 shown in FIG. 3 detects the path of oscillation of the screen box. The sensor 100 signals the processor 102 shown in FIG. 10, and the processor uses the signal from the sensor to construct an output signal to the actuator 104, such as by an algorithm. The actuator 104 actuates the pump 106 to pump fluid in the fluid reservoir 108 into the hydraulic cylinder 110 mounted to the weight 142, which is essentially identical to the weight 42 of the preferred embodiment except for the hydraulic cylinders 110 and 112 in place of the coil springs 52-58.

The sensor detects the position of the screen box and sends a signal to the processor. The processor processes the signal and, upon the signal meeting predetermined criteria such as amplitude, the processor generates a signal to the actuator to pump more or less hydraulic fluid into the chamber of the hydraulic cylinder 110. The pump also pumps fluid to and from the other hydraulic cylinders mounted to the weight 142 actively to alter the position of the weight 142 and its partner weight on the other side of a screen box to optimize the performance of the screening plant.

Of course, other alternative feedback loop mechanisms will be apparent to the person of ordinary skill in the art, as will alternative weight shapes, attachments to the driveshaft, etc.

The relative position of the eccentric weight system's center of gravity to the axis of rotation has been described above. In general, because it is not necessary, and because it is expensive, to eliminate all vibration caused by misalignment of the center of gravity of the eccentric weight system and the driveshaft's axis, perfect alignment is not attempted. Therefore, there is some insubstantial misalignment in most, if not all, machines.

However, an eccentric weight system can have a misalignment between the center of gravity of the eccentric weight system and the driveshaft's axis that is not insubstantial. Such an eccentric weight system can still provide the advantages of the present invention, albeit to a lesser degree.

For example, the inventors have determined that in an eccentric weight system the amount of misalignment is acceptable if, when the weight is restrained from moving outwardly from its rest position during rotation at operating speed, the eccentric weight system creates vibration of approximately one-tenth the amplitude as when the weights are permitted to move to their operating position. Therefore, whatever misalignment creates that one-tenth vibration is acceptable. Increasing the misalignment of the center of gravity and the axis of rotation will cause correspondingly increased amplitude, and decreasing the misalignment will cause correspondingly decreased amplitude. It will be apparent to the person of ordinary skill in view of the instant description that the maximum amplitude that can be tolerated depends upon the designer of the screening plant. The inventors have determined that misaligning so as to have one-tenth of the amplitude is satisfactory, but they recognize and anticipate that others may, in keeping with the present invention, be satisfied with different, and indeed poor, performance while still embodying the essential principles of the invention. Others may accept, instead of misalignment that causes one-tenth of the amplitude, one-quarter, one-half or even three-quarters of the amplitude. Such misalignments will cause greater amplitude than the preferred embodiment, but will still reduce the number of damaging increases in amplitude over the prior art.

Figure 11:
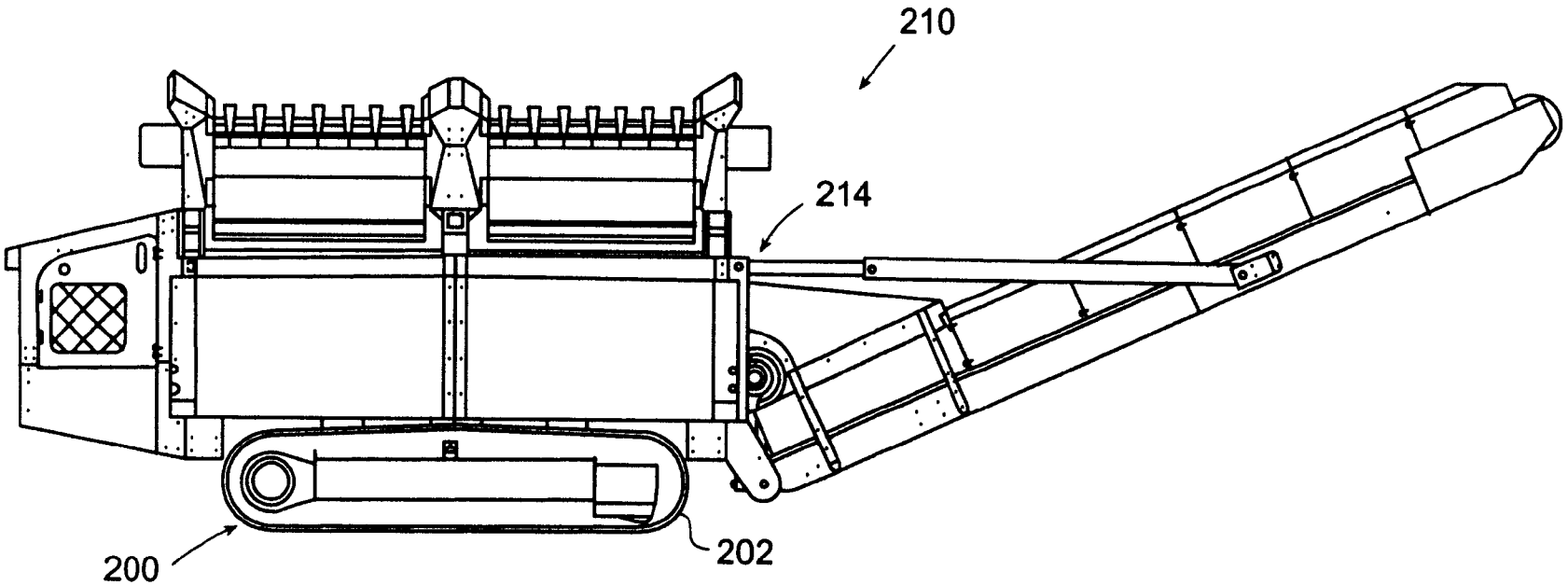
FIG. 11 is a side view illustrating an alternative embodiment of the present invention.
Figure 12:
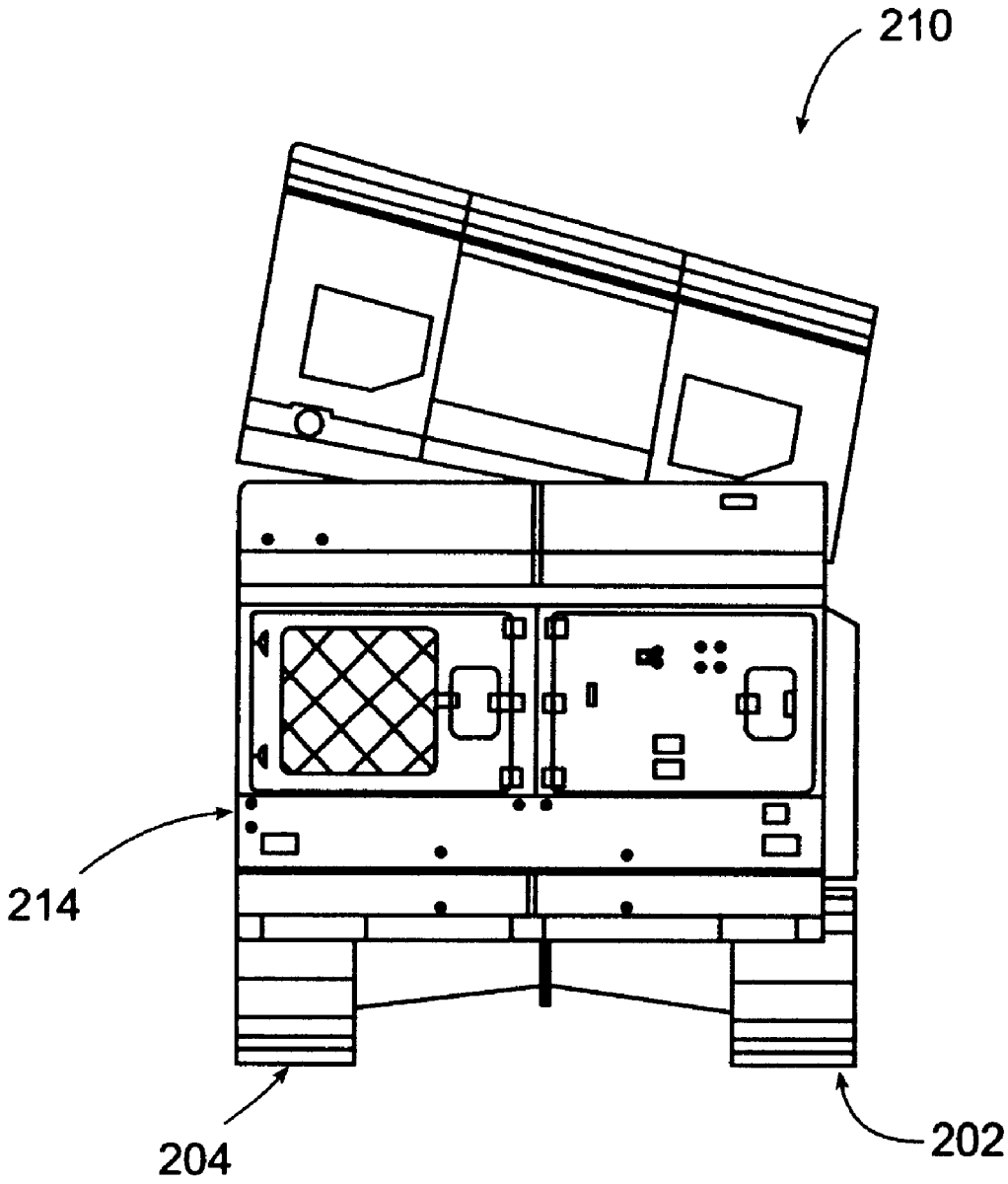
FIG. 12 is an end view illustrating the embodiment of FIG. 11.

An alternative screening plant 210 is shown in FIGS. 11 and 12. The screening plant 210 has the same vibration-control eccentric mechanism described above in relation to the screening plant 10, but it has a different mechanism by which the machine 210 is moved from place to place along the ground. The screening plant 210 is moved along the ground by an endless tracks apparatus 200, which includes a pair of endless tracks 202 and 204, similar to those found on bulldozers, military tanks, etc.

The operation of the tracks 202 and 204 is similar on the screening plant 210 as on the conventional machines, inasmuch as each of the tracks 202 and 204 extends around a driven sprocket or gear and a plurality of idler wheels. The sprocket drives the tracks, and the idler wheels align and support the tracks 202 and 204 and therefore the screening machine 210.

The driven sprockets are drivingly linked to a prime mover (not shown), which is preferably an internal combustion engine mounted to the frame 214. The prime mover is preferably the same prime mover that drives the driveshaft on which the weights are mounted, but does not have to be. For example, the prime mover can be an engine that drives a hydraulic pump. The hydraulic pump is linked by hydraulic lines to one or more hydraulic motors, which motors are driven by the hydraulic fluid flowing through the hydraulic lines. The sprockets and idler wheels are rotatably mounted to the frame 214, or a member that is rigidly mounted to the frame 214. The endless tracks apparatus 200 is preferably mounted substantially directly beneath the frame 214 to support and balance the machine 210.

Upon actuation, the sprockets are driven either both forward, both backward or one forward and one backward, (in order to turn the machine 210) as controlled by a remote control apparatus (not shown). The remote control apparatus includes a transmitter either held by the operator or mounted in a vehicle loading the machine 210, and a receiver mounted on the machine 210 and connected to the controls for the machine 210. Thus, the operator actuates the machine 210 by transmitting control signals to the receiver from the transmitter, and the receiver 122 actuates the prime mover and/or controls of the screening plant 210.

The screening plant 210 has the advantage that it is portable, and because it is self-propelled no vehicle is needed to tow it. Thus, the screening plant 210 can be moved along the ground and operated without assistance from any other vehicle. Additionally, no supporting structures, such as legs, are needed to hold the weight of the machine shown with a hopper full of particulate, because the tracks apparatus 200 can support this weight. However, as the instant invention can be used on longer machines, such as those shown in the above-referenced co-pending U.S. patent application Ser. No. 10/100,455, support legs may be desirable or necessary on such machines.

Of course, many other means for conveying a screening plant are contemplated so as to make the screening plant portable. For example, one could use a plurality of driven wheels, blades, skis, cables and pulleys, chains or any other equivalent structure to make a screening plant portable. A screening plant is portable if it can be moved from one point to another with relative ease by one individual or a small number of people, so as to make it practical in an environment in which it is designed to be used or is normally used.

While certain preferred embodiments of the present invention have been disclosed in detail, it is to be understood that various modifications may be adopted without departing from the spirit of the invention or scope of the following claims.

What is claimed is:

1. A portable screening plant having a screen that screens particulate matter positioned thereon, the screening plant comprising:

(a) a housing to which the screen is mounted;

(b) a prime mover mounted to the housing;

(c) a pair of endless tracks mounted to the housing and having surfaces for seating against a ground upon which the screening plant rests, the tracks being drivingly linked to the prime mover for driving the tracks along the ground;

(d) a driveshaft drivingly linked to the prime mover and rotatably mounted to the screening plant;

(e) a weight having its center of gravity spaced from the driveshaft's axis of rotation, said weight being radially movably mounted to the driveshaft for moving radially outwardly under centrifugal force during rotation of the driveshaft at a rate greater than a preselected rate to form an eccentric that causes the driveshaft, and the screen mounted thereto, to vibrate;

(f) at least one bias connected to the driveshaft and the weight, said bias biasing the weight's center of gravity toward closer proximity to the driveshaft's axis of rotation for returning the weight to a rest position when the driveshaft is rotating is at a rate less than a preselected rate; and (g) a plate rigidly mounted to the driveshaft and to which the weight is radially movably mounted.

2. The portable screening plant in accordance with claim 1, wherein the weight's center of gravity is aligned substantially along the driveshaft's axis of rotation when the driveshaft is rotating at a rate less than a preselected rate, and is spaced from the driveshaft's axis of rotation when the driveshaft is rotating at a rate greater than a preselected rate.

3. The portable screening plant in accordance with claim 1, wherein the plate has a radial slot formed in it, said slot having an inner slot end and an outer slot end.

4. The portable screening plant in accordance with claim 3, wherein the weight has a finger that extends into, and is slidably mounted within, the radial slot in the plate, and wherein the inner slot end and the outer slot end define the radially extreme limits of the weight's finger.

5. The portable screening plant in accordance with claim 4, wherein said bias comprises at least one spring mounted to the weight and the plate.

6. The portable screening plant in accordance with claim 5, further comprising a screw having a radially extensible tip extending into the radial slot for resting against the finger at the finger's extreme limit.

7. The portable screening plant in accordance with claim 2, further comprising a centrifugal clutch drivingly linked to the prime mover and the driveshaft for effecting rotation of the driveshaft only after the prime mover is rotating at greater than a preselected rate.

8. The portable screening plant in accordance with claim 1, wherein the bias is a fluid spring with an adjustable spring constant, k.

9. A portable screening plant having a screen that screens particulate matter positioned thereon, the screening plant comprising:

(a) a housing to which the screen is mounted;

(b) a prime mover mounted to the housing;

(c) a pair of endless tracks mounted to the housing and having surfaces for seating against a ground upon which the screening plant rests, the tracks being drivingly linked to the prime mover for driving the tracks along the ground;

(d) a driveshaft drivingly linked to the motor and rotatably mounted to the screening plant;

(e) a plate rigidly mounted to the driveshaft;

(f) a radially displaceable weight having a finger mounted within a radial slot formed in the plate; and (g) at least one bias mounted to the plate and the weight for biasing the weight's center of gravity toward closer proximity to the driveshaft's axis of rotation;

wherein an eccentric weight system's center of gravity is aligned substantially along the driveahaft's axis of rotation when the driveshaft is rotating at a rate less than a preselected rate, and is spaced from the driveshaft's axis of rotation when the driveshaft is rotating at a rate greater than a preselected rate.

10. The portable screening plant in accordance with claim 9, wherein the bias is a coil spring.

11. The portable screening plant in accordance with claim 10, wherein the bias is a plurality of coil springs.

12. A portable screening plant having a screen that screens particulate matter positioned thereon, the screening plant comprising:

(a) a housing to which the screen is mounted;

(b) a prime mover mounted to the housing;

(c) means for conveying the screening plant from a first location to a second location;

(d) a driveshaft drivingly linked to the prime mover and rotatably mounted to the screening plant;

(e) a weight having its center of gravity spaced from the driveshaft's axis of rotation, said weight being radially movably mounted to the driveshaft for moving radially outwardly under centrifugal force during rotation of the driveshaft at a rate greater than a preselected rate to form an eccentric that causes the driveshaft, and the screen mounted thereto, to vibrate;

(f) at least one bias connected to the driveshaft and the weight, said bias biasing the weight's center of gravity toward closer proximity to the driveshaft's axis of rotation for returning the weight to a rest position when the driveshaft is rotating at a rate less than a preselected rate; and (g) a plate rigidly mounted to the driveshaft and to which the weight is radially moveably mounted.

* * * * *